US005099215A

United States Patent [19]

Woods et al.

[11] Patent Number: 5,099,215

[45] Date of Patent: Mar. 24, 1992

[54] COUPLING DEVICE FOR A SUPERCONDUCTING MAGNET

[75] Inventors: Daniel C. Woods; William S. Stogner, both of Florence, S.C.

[73] Assignee: General Electric Company, Milwaukee, Wis.

[21] Appl. No.: 574,026

[22] Filed: Aug. 29, 1990

[51] Int. Cl.[5] ..... H01F 7/22

[52] U.S. Cl. ..... 335/216; 174/15.4

[58] Field of Search ..... 335/216, 299; 174/15.4, 174/125.1

[56] References Cited

U.S. PATENT DOCUMENTS 4,187,387 2/1980 Parmer ..... 174/125.1

4,910,626 3/1990 Collet et al. ..... 174/125.1

*Primary Examiner*—George Harris

*Assistant Examiner*—Ramon M. Barrera

*Attorney, Agent, or Firm*—James O. Skarsten; Douglas E. Stoner

[57] ABSTRACT

The device is provided for detachably coupling a power source to a lead pin of the superconducting magnet, the magnet being located in a cryostat using helium and the lead pin being in the region of helium vapor. Device includes a split connector formed to engage the pin, an elongated rod joined to the connector in conductive relationship, and a torque tube positioned around the rod in rotatable relationship. The tube is rotated, a nut joined to the tube and positioned around split connector causes the connector to tightly grip the pin. The device is configured to direct a flow of helium vapor along a path which is proximate to the interface between the connector and pin, to remove heat from the interface and thereby reduce resistance to current flow across the interface.

8 Claims, 2 Drawing Sheets

COUPLING DEVICE FOR A SUPERCONDUCTING MAGNET

BACKGROUND OF THE INVENTION

The invention disclosed and claimed herein generally pertains to a device for detachably coupling a source of electric power to a superconducting magnet. More particularly, the invention pertains to a device of such type which is designed to reduce resistance in establishing an electrical path between the source and an input lead of the magnet.

As is well known, a magnet can be made superconductive by placing it in an extremely cold environment, such as by enclosing it in a cryostat containing liquid helium or other cryogen. The extreme cold causes the resistance in the magnet coils to become negligible. A power source is initially connected to the coils, to introduce a current thereinto, and then removed. However, the current continues to flow through the coils due to the negligible resistance, thereby maintaining a magnetic field. Superconducting magnets find wide application, for example, in the field of magnetic resonance imaging.

In some common configurations, the magnet input terminals comprise lead pins located deep within the cryostat, proximate to the cryogen. Elongated connectors, coupled through cables to a power source, are inserted through ports to engage respective pins in electrically conductive relationship. After a current sufficient to establish a desired magnetic field has been coupled to the coils, the power leads are retracted through the ports.

In such arrangements, the contact surface or interface between a connector and a lead pin can have unacceptably high resistance to current flow, due to the temperature differential between the pin, located in the cryostat, and the connector which is initially at ambient temperature. If the resistance is too high, heat will be generated at the interface, causing the resistance to increase further, and possibly resulting in quenching of the magnet, i.e., loss of superconductivity. Resistance at the interface or contact surface is on the order of 50–100 microohms for certain prior-art connectors.

In addition, prior art connectors of the above type have tended to use a spring-type mechanism which fits over the pin to hold the connector in place. Such mechanisms tend to have insufficient strength to tightly grip the pin, thereby also increasing resistance at the pin-connector interface. Such mechanisms may also be subject to frequent breakage.

SUMMARY OF THE INVENTION

The present invention provides a device for detachably coupling a power source to an electrical input member of a superconducting magnet located in a cryostat containing a cryogen. The input member, such as a lead pin, is located in a region of cryogen vapor, and the device includes an electrically conductive engagement member formed to receive at least a portion of the input member. The device further includes an electrically conductive rod, joined to the engagement member and connectable to the power source, and a tubular member positioned around the rod in rotational relationship. Structure proximate to the engagement member is provided for releasably locking the engagement member to an input member received thereinto, when rotation occurs between the tubular member and the rod. The engagement member is provided with at least one opening located to enable cryogen vapor to flow through a space or along a path proximate to the interface between the engagement member and the input member to remove heat from the interface. Resistance to the flow of electric current across the interface is thereby reduced. After passing through the space, the cryogen vapor carrying the heat from the interface flows along a passage provided between the rod and the tubular member. Preferably, the cryogen vapor comprises helium vapor.

An object of the invention is to provide a device for coupling electric power to a superconductive magnet which significantly reduces resistance to current flow.

Another object is to provide a device of the above type which employs cryogen vapor for removing heat from the interface between the device and a magnet input terminal to reduce resistance therebetween.

Another object is to provide a device of the above type which can be easily attached to a magnet input terminal in tightly gripping relationship.

These and other objects and advantages will become more readily apparent from the following description, taken in conjunction with the accompanying drawings.

DETAILED DESCRIPTION OF THE PREFERRED EMBODIMENT

Figure 1:
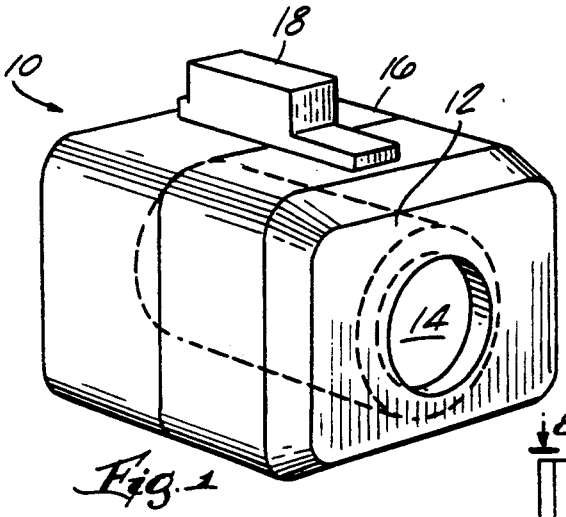
FIG. 1 shows a main magnet system, in simplified form, for a magnetic resonance imaging system.

FIG. 1 shows a simplified main magnet system 10 for a magnetic resonance imaging system, the system 10 including a cryostat 12 containing a superconductive magnet (not shown in FIG. 1). The magnet generates a magnetic field in a bore 14, formed in the cryostat 12. Such field comprises the main magnetic field for magnetic resonance imaging, and the bore 14 is sized to receive a subject for such imaging. As is well known, the main magnetic field must be homogeneous, unvarying and very strong (e.g., 0.5–1.5 Tesla). The cryostat is enclosed within a shroud 16 surmounted by a structure 18. The structure 18 may include an opening or port (not shown) which provides access into the interior of the cryostat, to enable an operator to fill the cryostat with cryogen, and also to couple an electric current to the magnet, as required.

Figure 2:
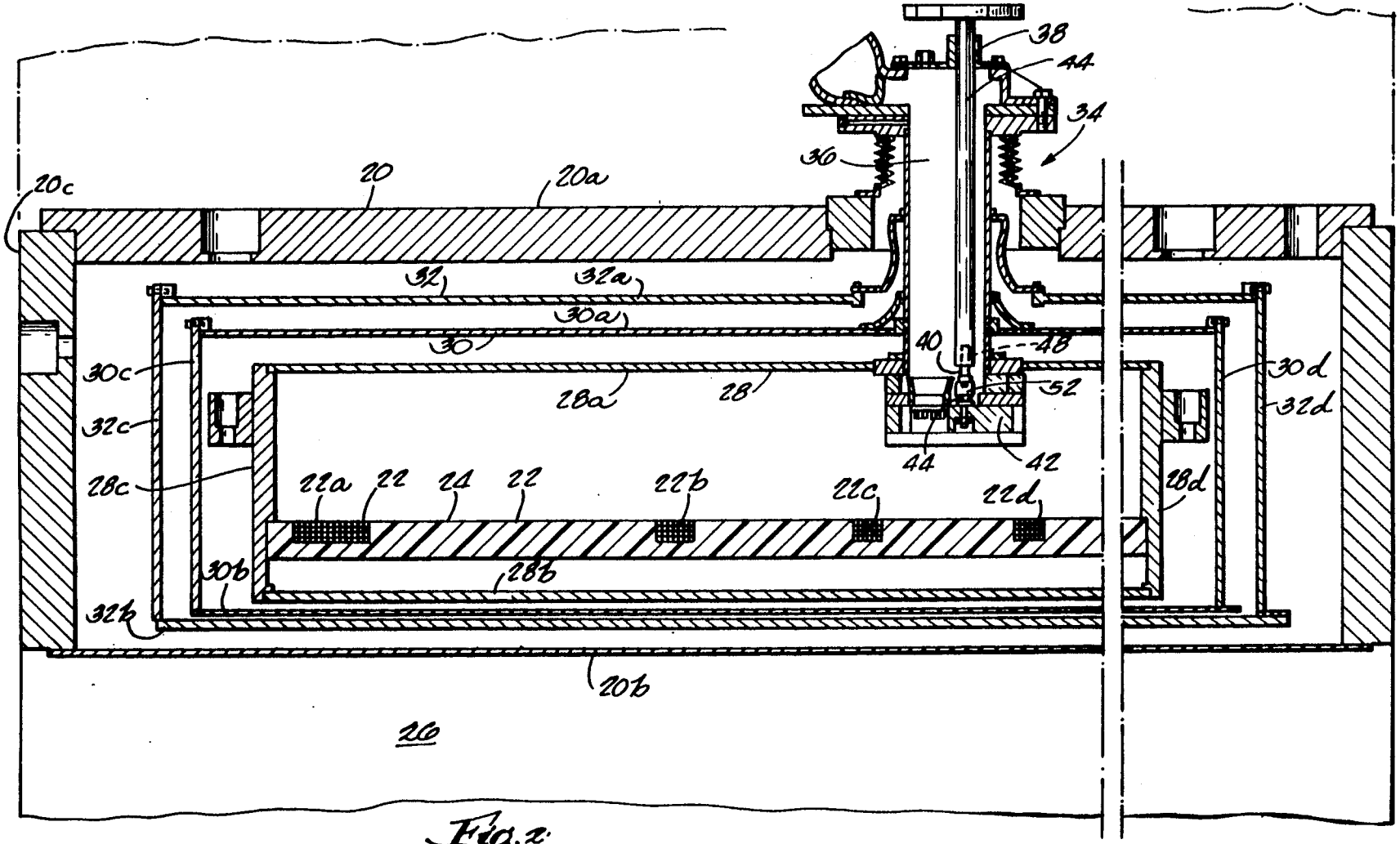
FIG. 2 is a sectional view taken through the upper portion of a main magnet system showing more detail than that of FIG. 1, and further shows an embodiment of the invention used in connection therewith.

FIG. 2 shows a portion of a cryostat 20, provided to maintain a magnet 22 in an extremely cold environment so that the magnet 22 operates in a superconducting mode. Magnet 22 comprises a number of coils, such as coils 22*a–d*, respectively mounted on a cylindrical coil form 24 positioned around a magnet bore 26.

The cryostat 20 and related structure may be similar to that disclosed in commonly assigned U.S. Pat. No. 4,771,256, issued Sept. 13, 1988 to Laskaris et al. In such arrangements, the magnet 22 is enclosed in a hermetically sealed cryogen vessel 28 comprising outer and inner cylindrical walls 28*a* and 28*b*, both coaxial with the bore 26, and annular end caps 28*c* and 28*d*. The vessel 28 contains a cryogen, such as liquid helium (not shown), which is on the order of 4° K. and thereby maintains the magnet 22 in a superconductive state. The cryogen vessel 28 is enclosed within coaxial vacuum vessels 30 and 32, which serve to establish vacuum spaces around vessel 28 to inhibit movement of heat toward vessel 28 from the surrounding environment. Vacuum vessels 30 and 32 respectively comprise outer cylindrical walls 30*a* and 32*a*, inner cylindrical inner walls 30*b* and 32*b*, and annular end caps 30*c–d* and 32*c–d*. Vessels 28, 30 and 32 are enclosed within the cryostat 20, comprising outer and inner cylindrical walls 20*a* and 20*b*, both coaxial with the bore 26, and annular end caps 20*c* and 20*d*.

FIG. 2 further shows a turret 34 mounted on cryostat 20 to sealably enclose a well 36 which extends into the interior of cryogen vessel 28. Turret 34 is provided with a sealable port 38. To activate magnet 22, electric power must be coupled between a DC power source (not shown) and a terminal lead pin 40 located deep within well 36, proximate to the cryogen. Lead pin 40 is of either positive or negative polarity, and is in electrical contact with a block of conductive material 42, which is in turn electrically connected to one end of magnet 22 by means which are not shown, but are conventional in nature. An identical lead pin 40 (not shown) which is of opposite polarity, is likewise located deep within well 36 and connected to the other end of magnet 22.

Sufficient electric current must be coupled to the magnet, through the lead pins 40, to generate a magnetic field of a specified level in bore 26. Thereafter, the power source is disconnected from the lead pins, and a current will continuously circulate through the superconductive coils of magnet 22 to generate the field, unless magnet quenching occurs for some reason.

To detachably connect the power source to a lead pin 40, an embodiment of the invention, comprising an elongated coupling device 44, is usefully employed. Device 44 is inserted through port 38 by an operator to bring a split connector 48, located at one end of the device, into engagement with the lead pin. An electric cable (not shown in FIG. 2) from the power source (not shown) is connected to the opposite end of device 44. Device 44 is constructed, as hereinafter described, to provide an electrical path for current flowing between the power source and the engaged pin. Another device 44 and cable (not shown) are used to couple the other lead pin 40 (not shown) to the power source. When the field of magnet 22 reaches the above specified level, both devices 44 are detached from their respective pins, and withdrawn through the port 38, which is then sealed.

Since the lead pins 40 are located deep within well 36 as shown in FIG. 2, they are in a region of helium (or other cryogen) vapor boiling off from the liquid helium in the cryostat 28.

Figure 3:
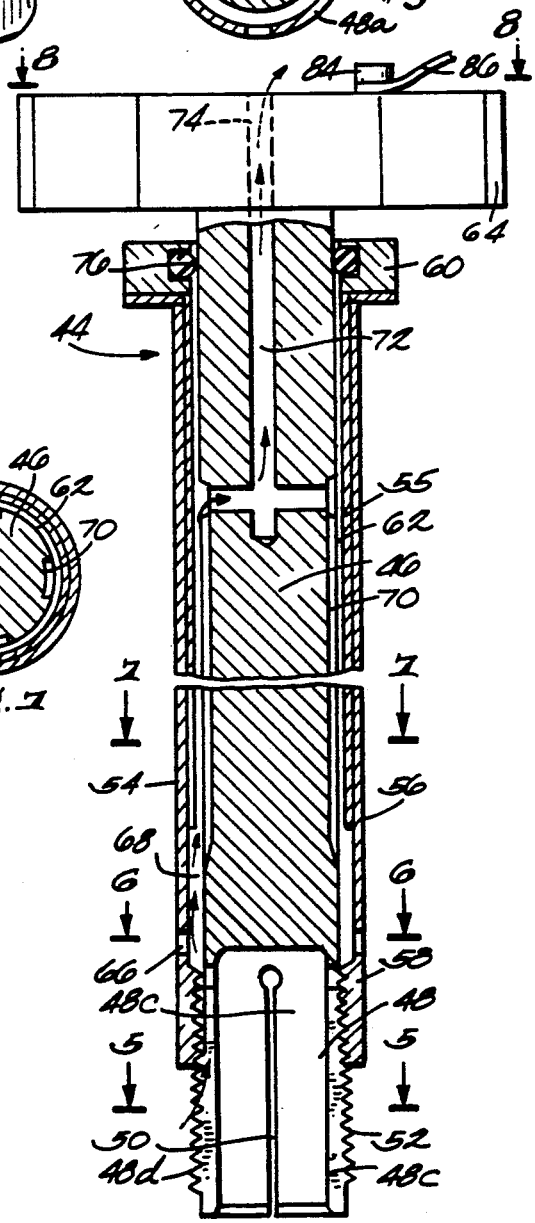
FIG. 3 is a sectional view showing the embodiment of FIG. 2 in greater detail.

FIG. 3 shows device 44 including a rod 46 formed out of conductive material, such as tellurium copper. The split connector 48 likewise comprises conductive material such as tellurium copper, and is joined to an end of rod 46 in electrically conductive relationship. The split connector generally comprises a hollow cylinder which is dimensioned to receive a lead pin 40. Four longitudinal slots 50 are provided through the wall of connector 48 so that the connector substantially comprises fingers 48*a–d*. Each of the fingers can be flexed inwardly toward or outwardly from the cylindrical space surrounded by connector 48. Pipe threads 52 are formed around the outside of connector 48.

FIG. 3 further shows a torque tube 54 positioned around rod 46. Tube 54 preferably comprises an inner sleeve 55, formed of stainless steel, and an outer sheath 56 formed of beryllium copper. A nut 58, having threads in engagement with threads 52 of the split connector 48, is joined to the lower end of torque tube 54, as viewed in FIG. 3, in fixed relationship. A hexnut 60 is joined to the upper end of torque tube 54, as viewed in FIG. 3, likewise in fixed relationship. A slight clearance 62 is provided between torque tube 54 and rod 46, so that the torque tube 54 and the nut 58 joined thereto are rotatable with respect to rod 46 and split connector 48. Rotation of the torque tube 54 and nut 58 will thus cause the fingers of the split connector to move inwardly or outwardly, depending on the direction of rotation. Rotation is best accomplished by applying a wrench or like tool to hexnut 60.

Figure 8:
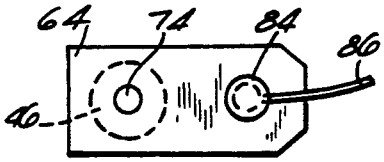
FIG. 8 is an overhead view taken along the lines 8—8 of FIG. 3.

A copper lug 64, described hereinafter in greater detail in connection with FIG. 8, is joined to the rod 46 in electrically conductive relationship. An electric power cable 86 is attached to lug 64 to couple the lug and the rod 46 to a source of electric power (not shown).

FIG. 3 further shows a plurality of vents 66 formed through the wall of torque tube 54 and opening into an annular space 68 located between the rod 46 and the torque tube 54. Slots 70 are formed around the periphery of rod 46 between annular space 68 and a passage 72, which traverses the upper end of rod 46. Passage 72 is in communication with a port 74, formed through lug 64 to open into the atmosphere. An O-ring seal 76 is located in a recess formed in the hexnut 60, and is fitted around rod 46 to seal the upper end of the clearance 62 between the rod 46 and the torque tube 54.

As stated above, pin 40 is located in a region of cryogen vapor, which is at or close to the 40° K. temperature of the liquid cryogen in the cryostat. Accordingly, when device 44 is inserted into well 36 to bring split connector 48 into contact with the pin 40, as described above, the device 44 will be much warmer than the pin 40. Consequently, cryogen vapor will enter the annular space 68 through the slots 50 between fingers 48*a–d*, as well as through the vents 66, and flow upwardly along slots 70 to the passage 72. The vapor will continue to move upwardly through the passage 72 and be vented into the atmosphere through the port 74. The flowing vapor removes heat from the interface or contact area 78 between the connector 48 and pin 40. Thus, the connector is rapidly cooled and any heat generated by current flow across interface 78 is rapidly dissipated, preventing an increase in resistance thereacross.

Measurements have indicated that when cryogen vapor is employed to carry heat away from the interface 78, by means of the configuration described above, the contact resistance between the connector 48 and the pin 40, that is, the resistance across the interface 78, is on the order of 5–10 micro-ohms. As stated above, the contact resistance of typical commerically available lead pin connectors is on the 50–100 micro-ohm range.

Figure 4:
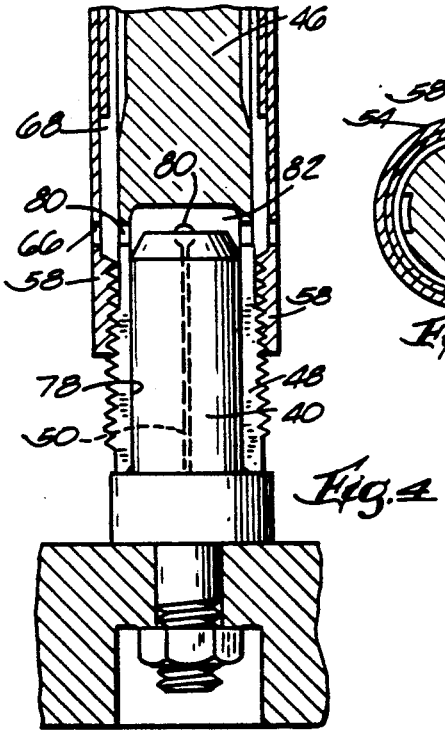
FIG. 4 is a sectional view showing a portion of the embodiment of FIG. 2 in engagement with a main magnet lead pin.

Referring to FIG. 4, there is shown a split connector 48 of device 44 in tightly engaging relationship with a terminal lead pin 40. Each slot 50 is enlarged at its upper end (as viewed in FIG. 4) into a vent 80, so that cryogen vapor in annular space 68 will flow into a space 82 between the split connector and the pin 40. FIG. 4 further shows nut 58 rotated to force fingers 48*a–d* inwardly to tightly grip pin 40. Such tight engagement further reduces resistance to current flow across interface 78.

Figure 5:
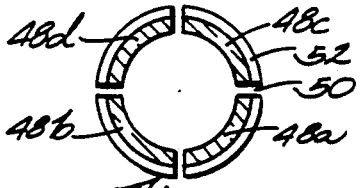
FIG. 5 is a sectional view taken along the lines 5—5 of FIG. 3.

FIG. 5 shows each of the fingers 48*a–d* of connector 48, as well as the slots 50 which form the fingers.

Figure 6:
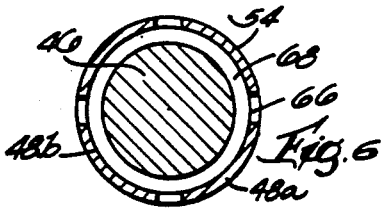
FIG. 6 is a sectional view taken along the lines 6—6 of FIG. 3.

FIG. 6 shows four vents 66 formed through torque tube 54 to communicate with annular space 68.

Figure 7:
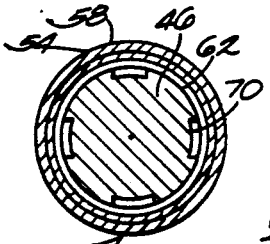
FIG. 7 is a sectional view taken along the lines 7—7 of FIG. 3.

FIG. 7 shows four slots 70 formed along rod 46, although a different number of slots can be used if desired.

FIG. 8 shows lug 64 having a terminal 84 coupled to an end of a cable 86, the other end of which is attached to an electric power source (not shown).

While a preferred embodiment of the invention has been shown and described herein, it will be understood that such embodiment is provided by way of example only. Numerous variations, changes and substitutions will occur to those skilled in the art without departing from the spirit of the invention. Accordingly, it is intended that the appended claims cover all such variations as followed in the spirit and scope of the invention.

What is claimed is:

1. A device for detachably coupling a power source to an electrical input member of a superconducting magnet, said magnet located in a cryostat containing a cryogen and said input member located in a region of cryogen vapor, said device comprising:

an electrically conductive engagement member formed to receive at least a portion of said input member;

an electrically conductive rod joined to the engagement member and connectable to said power source;

a tubular member positioned around the rod in rotational relationship;

means proximate to the engagement member for releasably locking the engagement member to the received input member when rotation occurs between the tubular member and the rod; and the engagement member is provided with at least one vent located to enable cryogen vapor from said region to flow along a path, at least a portion of which is proximate to an interface between the engagement member and the received input member, to remove heat from the interface and to thereby reduce resistance to electric current flow across said interface.

2. The device of claim 1 wherein:

the tubular member is positioned around the rod to form a closed annular space between the rod and the tubular member; and the tubular member is provided with at least one vent located to enable cryogen vapor to enter the annular space to cool the rod and thereby reduce resistance to the flow of electric current through the rod.

3. The device of claim 2 wherein:

said at least one vent provided in the engagement member is further located for enabling cryogen vapor to flow into said annular space.

4. The device of claim 3 wherein:

the input member comprises a lead pin;

the engagement member comprises a split connector having a plurality of fingers positioned around a space dimensioned to receive the pin, outer threads being formed on the fingers; and the locking means comprises a nut in engagement with said outer threads and joined to an end of the tube member for rotation with the tube member to urge the fingers of the split connector inwardly to tightly grip the pin.

5. The device of claim 4 wherein:

the tubular member comprises a torque tube extending along the length of said rod; and structure for engaging a wrench is located at the end of the torque tube opposite the nut.

6. The device of claim 5 wherein:

means are positioned between the rod and the torque tube proximate to the wrench engagement member for sealing said annular space; and a vent is formed in the rod proximate to the wrench engagement member for venting cryogen vapor in the annular space into the atmosphere.

7. The device of claim 4 wherein:

the rod is formed of tellurium, and an electrical insulator is placed around the tubular member.

8. The device of claim 4 wherein:

the cryogen vapor comprises helium vapor.

* * * * *